US010781823B2

(12) United States Patent
Yoshizaki et al.

(10) Patent No.: US 10,781,823 B2
(45) Date of Patent: Sep. 22, 2020

(54) IMPELLER AND SUPERCHARGER

(71) Applicant: IHI Corporation, Koto-ku (JP)

(72) Inventors: Taiki Yoshizaki, Tokyo (JP); Koutarou Itou, Tokyo (JP); Takashi Yoshida, Tokyo (JP); Takuya Ozasa, Tokyo (JP); Kuniaki Iizuka, Tokyo (JP)

(73) Assignee: IHI Corporation, Koto-ku (JP)

( * ) Notice: Subject to any disclaimer, the term of this patent is extended or adjusted under 35 U.S.C. 154(b) by 113 days.

(21) Appl. No.: 15/937,100

(22) Filed: Mar. 27, 2018

(65) Prior Publication Data

US 2018/0209437 A1 Jul. 26, 2018

Related U.S. Application Data

(63) Continuation of application No. PCT/JP2016/078660, filed on Sep. 28, 2016.

(30) Foreign Application Priority Data

Oct. 2, 2015 (JP) ..... 2015-196472

(51) Int. Cl.
*F04D 29/28* (2006.01)
*F04D 29/30* (2006.01)
(Continued)

(52) U.S. Cl.
CPC ..... *F04D 29/284* (2013.01); *F02B 39/10* (2013.01); *F04D 25/06* (2013.01); *F04D 29/30* (2013.01)

(58) Field of Classification Search
None
See application file for complete search history.

(56) References Cited

U.S. PATENT DOCUMENTS 4,850,802 A 7/1989 Pankratz et al.
2005/0175465 A1 8/2005 Nishiyama et al.
(Continued)

FOREIGN PATENT DOCUMENTS

CN 1800587 7/2006
CN 102472293 A 5/2012
(Continued)

OTHER PUBLICATIONS

Combined Office Action and Search Report dated Mar. 12, 2019 in Chinese Patent Application No. 201680056597.9, 15 pages (with English translation and English translation of categories of cited documents).
(Continued)

*Primary Examiner* — Igor Kershteyn
*Assistant Examiner* — Juan G Flores
(74) *Attorney, Agent, or Firm* — Oblon, McClelland, Maier & Neustadt, L.L.P.

(57) ABSTRACT

An impeller includes: a main body portion which is increased in diameter from one side to another side in a rotation axis direction; a thinned portion, which is formed in a back surface of the main body portion so as to be oriented toward the another side in the rotation axis direction, and is recessed toward the one side in the rotation axis direction; a plurality of full blades which are formed on an outer circumferential surface of the main body portion so as to be oriented toward the one side in the rotation axis direction; and a plurality of splitter blades, which are formed on the outer circumferential surface, and have end portions being located on the one side in the rotation axis direction and being positioned on the another side in the rotation axis direction with respect to the full blades.

3 Claims, 2 Drawing Sheets

(51) Int. Cl.
*F04D 25/06* (2006.01)
*F02B 39/10* (2006.01)

(56) References Cited

U.S. PATENT DOCUMENTS

| | | | | |
|---|---|---|---|---|
| 2006/0140767 | A1 | 6/2006 | Garman et al. | |
| 2012/0121432 | A1 | 5/2012 | Wakai et al. | |
| 2012/0156026 | A1 | 6/2012 | Merritt et al. | |
| 2012/0189456 | A1 | 7/2012 | Schiel et al. | |
| 2013/0183155 | A1* | 7/2013 | Stoicescu | F04D 29/2277 416/175 |
| 2013/0251531 | A1* | 9/2013 | Yagi | F04D 29/20 416/192 |
| 2015/0139805 | A1 | 5/2015 | Yagi et al. | |
| 2015/0139806 | A1 | 5/2015 | Yagi et al. | |
| 2015/0139807 | A1 | 5/2015 | Yagi et al. | |

FOREIGN PATENT DOCUMENTS

| | | | | |
|---|---|---|---|---|
| CN | 102536893 | | | 7/2012 |
| DE | 10 2005 055 320 | A1 | | 7/2006 |
| DE | 10 2009 028 130 | A1 | | 2/2011 |
| EP | 0 124 325 | A1 | | 11/1984 |
| EP | 0 808 989 | A1 | | 11/1997 |
| GB | 658843 | A | | 10/1951 |
| GB | 2 058 941 | A | | 4/1981 |
| JP | S50-150805 | U | | 12/1975 |
| JP | 58-106198 | | | 6/1983 |
| JP | S59-085499 | A | | 5/1984 |
| JP | 60-104798 | | | 6/1985 |
| JP | 63-060239 | | | 11/1988 |
| JP | 02-132820 | | | 11/1990 |
| JP | 10-054201 | | | 2/1998 |
| JP | 2005-510663 | A | | 4/2005 |
| JP | 2005-226469 | | | 8/2005 |
| JP | 2007-120409 | A | | 5/2007 |
| JP | 2009-167882 | | | 7/2009 |
| JP | 2009167882 | A | * | 7/2009 |
| JP | 2011-085088 | | | 4/2011 |
| JP | 2012-122398 | | | 6/2012 |
| JP | 2014-238084 | | | 12/2014 |

OTHER PUBLICATIONS

Extended European Search Report dated Apr. 30, 2019 in Patent Application No. 16851652.4, 14 pages.
English translation of the International Preliminary Report on Patentability and Written Opinion dated Apr. 12, 2018 in PCT/JP2016/078660.
International Search Report dated Dec. 20, 2016 in PCT/JP2016/078660 filed Sep. 28, 2016 (with English Translation).
Written Opinion dated Dec. 20, 2016 in PCT/JP2016/078660 filed Sep. 28, 2016.

* cited by examiner

IMPELLER AND SUPERCHARGER

CROSS REFERENCE TO RELATED APPLICATIONS

This application is a continuation application of International Application No. PCT/JP2016/078660, filed on Sep. 28, 2016, which claims priority to Japanese Patent Application No. 2015-196472, filed on Oct. 2, 2015, the entire contents of which are incorporated by reference herein.

BACKGROUND ART

Technical Field

The present disclosure relates to an impeller, which includes a main body portion and a plurality of blades formed on an outer circumferential surface of the main body portion, and to a supercharger.

Related Art

There has been known an electric supercharger that includes a rotor provided to a shaft and a stator provided on a housing side. In the electric supercharger, the shaft is driven to rotate by a magnetic force generated between the rotor and the stator. The electric supercharger is one type of superchargers. An impeller is provided to the shaft of the electric supercharger. When the shaft is rotated by the electric motor, the impeller is rotated together with the shaft. The electric supercharger compresses air along with the rotation of the impeller and delivers the compressed air to an engine.

The impeller of the supercharger includes a main body portion. The main body portion is increased in diameter from one side to another side in a rotation axis direction. A plurality of blades are formed on an outer circumferential surface of the main body portion. In an impeller described in Patent Literature 1, a thinned portion which is recessed toward one side in a rotation axis direction is formed in a back surface of a main body portion.

CITATION LIST

Patent Literature

Patent Literature 1: Japanese Patent Application Laid-Open No. 2-132820

SUMMARY

Technical Problem

As described in Patent Literature 1 mentioned above, the impeller is downweighted through the formation of the thinned portion in the back surface of the main body portion of the impeller. In such a manner, inertia of the impeller is reduced. A response performance of the impeller is improved. However, when the thinned portion is simply formed, the strength of the impeller is reduced. Therefore, a rib is formed at the thinned portion of the impeller described in Patent Literature 1 to improve the strength. The rib extends in a radial direction. However, when such a rib is formed, the rib receives air resistance. As a result, efficiency is degraded.

It is an object of the present disclosure to provide an impeller and a supercharger which are capable of achieving downweighting and securing the strength while suppressing degradation in efficiency.

Solution to Problem

In order to solve the above-mentioned problem, according to one embodiment of the present disclosure, there is provided an impeller, including: a main body portion which is increased in diameter from one side to another side in a rotation axis direction; a thinned portion, which is formed in a back surface of the main body portion so as to be oriented toward the another side in the rotation axis direction, and is recessed toward the one side in the rotation axis direction; a plurality of full blades which are formed on an outer circumferential surface of the main body portion so as to be oriented toward the one side in the rotation axis direction; and a plurality of splitter blades, which are formed on the outer circumferential surface, and have end portions being located on the one side in the rotation axis direction and being positioned on the another side in the rotation axis direction with respect to the full blades.

The thinned portion may have a deepest portion, which is located at a position being the same as positions of the end portions of the splitter blades or may reach a position deeper than the end portions.

The impeller may further include: a cylindrical portion, which is formed on a back surface side of the main body portion, and protrudes toward the another side in the rotation axis direction with respect to the deepest portion of the thinned portion to serve as an outer wall of an insertion hole for receiving a shaft inserted to the insertion hole; and a rib, which is arranged apart from the cylindrical portion in a radial direction of the shaft, and protrudes from the back surface of the main body portion toward the another side in the rotation axis direction and extends in a circumferential direction of the shaft.

In order to solve the above-mentioned problem, according to another embodiment of the present disclosure, there is provided an impeller, including: a main body portion which is increased in diameter from one side to another side in a rotation axis direction; a plurality of blades which are formed on an outer circumferential surface of the main body portion so as to be oriented toward the one side in the rotation axis direction; and a thinned portion, which is formed in a back surface of the main body portion so as to be oriented toward the another side in the rotation axis direction, and is recessed toward the one side in the rotation axis direction; a cylindrical portion, which is formed on a back surface side of the main body portion, and protrudes toward the another side in the rotation axis direction with respect to a deepest portion of the thinned portion to serve as an outer wall of an insertion hole for receiving a shaft inserted to the insertion hole; and a rib, which is arranged apart from the cylindrical portion in a radial direction of the shaft, and protrudes from the back surface of the main body portion toward the another side in the rotation axis direction and extends in a circumferential direction of the shaft.

In order to solve the above-mentioned problem, according to one embodiment of the present disclosure, there is provided a supercharger, including the above-mentioned impeller.

Effects of Disclosure

With the impeller and the supercharger according to the present disclosure, downweighting can be achieved, and the strength can be secured without degrading the efficiency.

DESCRIPTION OF EMBODIMENT

Figure 1:
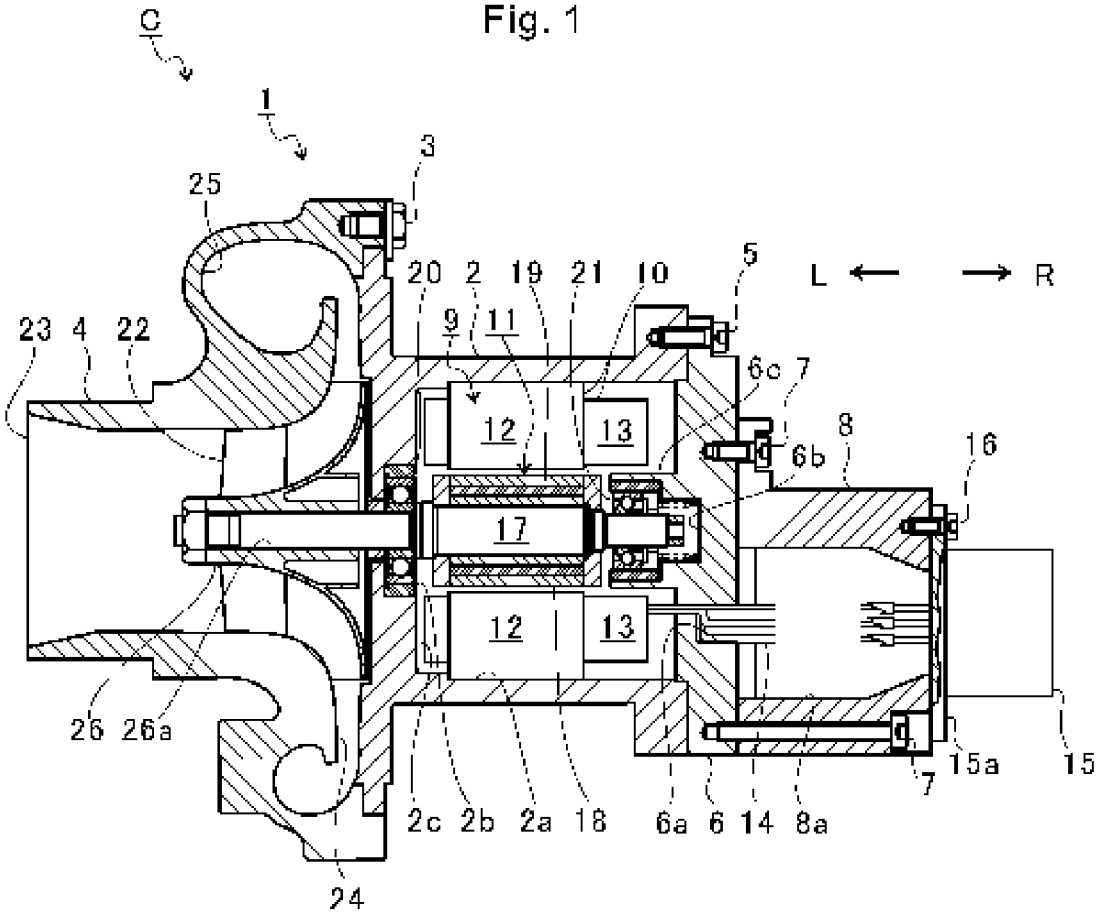
FIG. 1 is a schematic sectional view of an electric supercharger (supercharger).

Now, with reference to the attached drawings, an embodiment of the present disclosure is described in detail. The dimensions, materials, and other specific numerical values represented in the embodiment are merely examples used for facilitating the understanding of the disclosure, and do not limit the present disclosure otherwise particularly noted. Elements having substantially the same functions and configurations herein and in the drawings are denoted by the same reference symbols to omit redundant description thereof. Further, illustration of elements with no direct relationship to the present disclosure is omitted.

FIG. 1 is a schematic sectional view of an electric supercharger C (supercharger). In the following description, the direction indicated by the arrow L illustrated in FIG. 1 corresponds to a left side of the electric supercharger C, and the direction indicated by the arrow R illustrated in FIG. 1 corresponds to a right side of the electric supercharger C. As illustrated in FIG. 1, the electric supercharger C includes a supercharger main body 1. The supercharger main body 1 includes a motor housing 2. A compressor housing 4 is coupled to the left side of the motor housing 2 by a fastening bolt 3. A plate member 6 is coupled to the right side of the motor housing 2 by a fastening bolt 5. A cord housing 8 is coupled to the right side of the plate member 6 by a fastening bolt 7. The motor housing 2, the compressor housing 4, the plate member 6, and the cord housing 8 are integrated.

In the motor housing 2, there is formed a motor hole 2*a* that is opened on the right side in FIG. 1. In the motor hole 2*a*, an electric motor 9 is received. The electric motor 9 includes a stator 10 and a rotor 11. The stator 10 is formed by winding coils 13 on a stator core 12. The stator core 12 has a cylindrical shape.

A plurality of coils 13 are arranged in a circumferential direction of the stator core 12. The coils 13 are arranged in the order of U-phase, V-phase, and W-phase being phases of supplied alternate-current power. Lead wires 14 are provided to the U-phase, the V-phase, and the W-phase, respectively. One end of each of the lead wires 14 is coupled to each of the coils 13 of the U-phase, the V-phase, and the W-phase. The lead wires 14 supply the alternate-current power to the coils 13.

Further, the stator core 12 is inserted to the motor hole 2*a* from an opening side of the motor hole 2*a*. The stator core 12 is mounted in the motor hole 2*a*. An opening of the motor hole 2*a* on the right side is closed by the plate member 6. The cord housing 8 coupled to the plate member 6 has a cord hole 8*a*. The cord hole 8*a* penetrates in a right-and-left direction in FIG. 1. One end of the cord hole 8*a* is closed by the plate member 6. A plate hole 6*a* is formed in the plate member 6. The motor hole 2*a* and the cord hole 8*a* communicate with each other through the plate hole 6*a*. The lead wires 14 extend from the coils 13 to the cord hole 8*a* through the plate hole 6*a*.

The lead wires 14 are received in the cord hole 8*a*. Another end of each of the lead wires 14 on a side opposite to each of the coils 13 is coupled to a connector 15. The connector 15 has a flange portion 15*a*. The flange portion 15*a* closes another end of the cord hole 8*a* of the cord housing 8. The flange portion 15*a* is mounted to the cord housing 8 by a fastening bolt 16. The alternate-current power is supplied to the coils 13 of the stator 10 through the connector 15 and the lead wires 14. The stator 10 functions as an electromagnet.

Further, the rotor 11 is mounted to the shaft 17. The rotor 11 is inserted to the stator core 12. The rotor 11 has a gap with respect to the stator core 12 in a radial direction of the shaft 17. Specifically, the rotor 11 includes a rotor core 18. The rotor core 18 is a cylindrical member. The rotor core 18 has a hole penetrating in an axial direction of the shaft 17. A magnet 19 (permanent magnet) is received in the hole of the rotor core 18. The electric motor 9 generates a driving force in the rotation direction for the shaft 17 by a mutual force generated between the rotor 11 and the stator 10.

The shaft 17 is inserted to a housing hole 2*b* of the motor housing 2. The housing hole 2*b* penetrates in the axial direction of the shaft 17 through a wall portion 2*c* forming a bottom surface of the motor hole 2*a*. A ball bearing 20 is arranged in the housing hole 2*b*. The shaft 17 is axially supported by the ball bearing 20.

One end of the shaft 17, which protrudes toward the plate member 6 side with respect to the rotor 11, is inserted to a boss hole 6*b*. The boss hole 6*b* is formed in the plate member 6. An annular protrusion 6*c* is formed on the plate member 6. The annular protrusion 6*c* protrudes into the motor hole 2*a*. The annular protrusion 6*c* forms a part of an outer wall forming the boss hole 6*b*. A ball bearing 21 is arranged in the boss hole 6*b*. The shaft 17 is axially supported by the ball bearing 21.

Another end side of the shaft 17 protrudes from the housing hole 2*b* into the compressor housing 4. On a portion of the shaft 17, which protrudes into the compressor housing 4, a compressor impeller 22 (impeller) is provided. The compressor impeller 22 is received in the compressor housing 4 so as to be rotatable.

The compressor housing 4 has an intake port 23. The intake port 23 is opened on the left side of the electric supercharger C. The intake port 23 is connected to an air cleaner (not shown). Further, under a state in which the motor housing 2 and the compressor housing 4 are coupled to each other by the fastening bolt 3, a diffuser flow passage 24 is formed. The diffuser flow passage 24 is formed by opposed surfaces of the motor housing 2 and the compressor housing 4. The diffuser flow passage 24 increases the air in pressure. The diffuser flow passage 24 is annularly formed so as to extend from a radially inner side to a radially outer side of the shaft 17. On the above-mentioned radially inner side, the diffuser flow passage 24 communicates with the intake port 23 through intermediation of the compressor impeller 22.

Further, an annular compressor scroll flow passage 25 is provided to the compressor housing 4. The compressor scroll flow passage 25 is positioned on the radially outer side of the shaft 17 with respect to the diffuser flow passage 24. The compressor scroll flow passage 25 communicates with an intake port of an engine (not shown). The compressor scroll flow passage 25 communicates also with the diffuser flow passage 24.

The driving force generated by the electric motor 9 causes the compressor impeller 22 to rotate. The rotation of the compressor impeller 22 causes air to be sucked into the compressor housing 4. The air is sucked through the intake port 23 in the axial direction of the shaft 17. The sucked air is increased in speed by an action of a centrifugal force in the course of flowing through between blades of the compressor impeller 22 (through between a plurality of blades 27 described later). The air having been increased in speed is delivered to the diffuser flow passage 24 and the compressor scroll flow passage 25, and is increased in pressure (compressed). The air having been increased in pressure is led to the intake port of the engine.

Figure 2A:
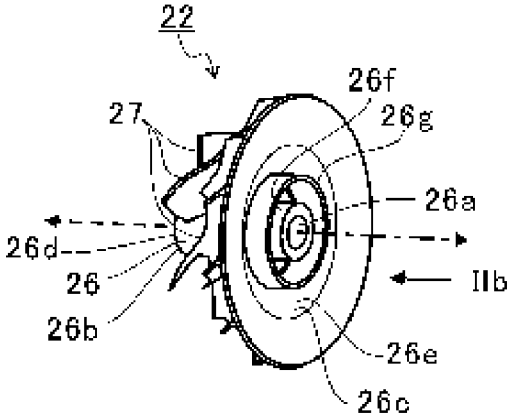
FIG. 2A is an external appearance perspective view of a compressor impeller.
Figure 2B:
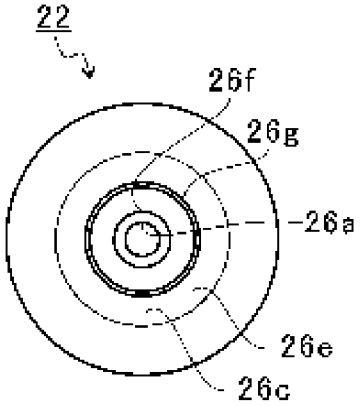
FIG. 2B is a view as seen from the direction indicated by the arrow IIb of FIG. 2A.

FIG. 2A is an external appearance perspective view of the compressor impeller 22. FIG. 2B is a view as seen from the direction indicated by the arrow IIb of FIG. 2A.

The compressor impeller 22 is made of, for example, carbon fiber reinforced plastic (CFRP). As illustrated in FIG. 2A, the compressor impeller 22 includes a main body portion 26 and a plurality of blades 27. The main body portion 26 is increased in diameter from one side (indicated by the broken line arrow on the left side in FIG. 2A) to another side (indicated by the one-dot chain line arrow on the right side in FIG. 2A) in a rotation axis direction. The main body portion 26 has an insertion hole 26*a*. The insertion hole 26*a* penetrates through the main body portion 26 in an axis direction of a rotation axis (hereinafter referred to as "rotation axis direction") about which the compressor impeller 22 rotates. That is, the insertion hole 26*a* penetrates through the main body portion 26 in an axial direction of the shaft 17. The shaft 17 is inserted to the insertion hole 26*a* (see FIG. 1).

The main body portion 26 has an outer circumferential surface 26*b* which is oriented toward the one side in the rotation axis direction. The main body portion 26 has a back surface 26*c* which is oriented toward the another side in the rotation axis direction. The outer circumferential surface 26*b* and the back surface 26*c* have a circular outer shape as seen from the rotation axis direction.

The outer circumferential surface 26*b* of the main body portion 26 is gradually increased in outer diameter toward the another side in the rotation axis direction.

The outer circumferential surface 26*b* has the plurality of blades 27. The plurality of blades 27 are separated apart in a circumferential direction of the outer circumferential surface 26*b*. The plurality of blades 27 protrude in a radial direction from the outer circumferential surface 26*b*. The plurality of blades 27 extend in a direction of inclining in the circumferential direction of the outer circumferential surface 26*b* with respect to the rotation axis direction of the compressor impeller 22.

The back surface 26*c* of the main body portion 26 has a thinned portion 26*e*. The thinned portion 26*e* is a portion which is recessed toward a front end surface 26*d* side. The front end surface 26*d* is formed at a distal end of the main body portion 26 on the one side in the rotation axis direction. The back surface 26*c* is a part of an inner wall of the thinned portion 26*e*. For example, the thinned portion 26*e* is formed so that the portion at which the back surface 26*c* is formed has a substantially constant thickness.

The thinned portion 26*e* has a cylindrical portion 26*f*. The cylindrical portion 26*f* protrudes from an inner circumferential surface of the thinned portion 26*e* toward the back surface 26*c* side in the rotation axis direction of the compressor impeller 22 (another side of the rotation axis). The insertion hole 26*a* is formed on an inner circumference side of the cylindrical portion 26*f*. That is, the cylindrical portion 26*f* serves as an outer wall of a portion of the insertion hole 26*a* on the back surface 26*c* side.

The thinned portion 26*e* has a rib 26*g* on a radially outer side of the main body portion 26 with respect to the cylindrical portion 26*f*. As illustrated in FIG. 2A and FIG. 2B, the rib 26*g* is formed into an annular shape. The rib 26*g* is arranged apart from the cylindrical portion 26*f* in the radial direction of the main body portion 26.

Figure 3:
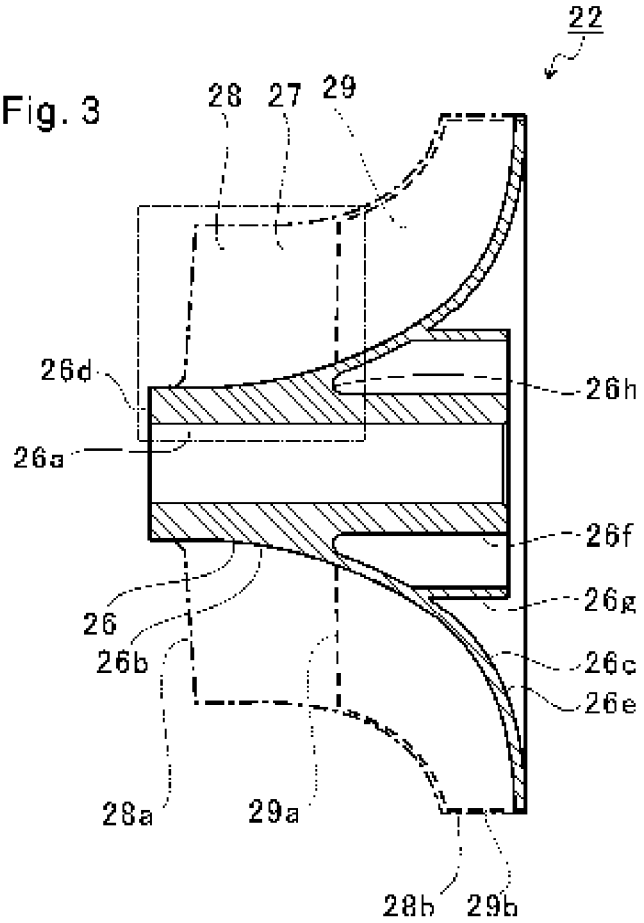
FIG. 3 is a sectional view taken along a plane including a rotation axis of the compressor impeller.

FIG. 3 is a sectional view taken along a plane including the rotation axis of the compressor impeller 22. In FIG. 3, the blades 27 are illustrated with respective shapes obtained as a result of projection in the rotation direction of the compressor impeller 22 (meridional shape).

As illustrated in FIG. 3, the cylindrical portion 26*f* protrudes from a deepest portion 26*h* of the thinned portion 26*e* toward the back surface 26*c* side along the rotation axis direction.

The plurality of blades 27 include full blades 28 (indicated by the one-dot chain lines in FIG. 3) and splitter blades 29 (indicated by the broken lines in FIG. 3). The full blades 28 and the splitter blades 29 protrude so as to approach a radially outer side from the outer peripheral surface 26*b* as extending from the one side (front end surface 26*d* side) toward the another side (back surface 26*c* side) in the rotation axis direction. End portions 29*a* of the splitter blades 29 on the one side in the rotation axis direction are located on the another side in the rotation axis direction with respect to end portions 28*a* of the full blades 28 on the one side in the rotation axis direction. The splitter blades 29 have smaller length in the rotation axis direction than the full blades 28. The full blades 28 and the splitter blades 29 are arranged alternately in the circumferential direction (rotation direction) of the outer circumferential surface 26*b*.

End portions 28*b* of the full blades 28 on the radially outer side of the outer circumferential surface 26*b* of the main body portion 26 and end portions 29*b* of the splitter blades 29 on the radially outer side of the outer circumferential surface 26*b* of the main body portion 26 extend to substantially the same positions in the radial direction and in the rotation axis direction.

Now, simple description is made of a flow of air around the compressor impeller 22. Air having flowed in through the intake port 23 flows from the end portion 28*a* side of the full blades 28 through gaps between the plurality of full blades 28 adjacent to each other. The air having flowed through the gaps between the plurality of full blades 28 adjacent to each other flows from the end portion 29*a* side of the splitter blades 29 through gaps between the plurality of blades 27 adjacent to each other (full blades 28 and splitter blades 29). The air having flowed through the gaps between the plurality of blades 27 adjacent to each other is delivered to the radially outer side along the outer circumferential surface 26*b* of the main body portion 26 and the plurality of blades 27 while being directed toward the back surface 26*c* side.

That is, the end portions 28*a* of the full blades 28 are upstream ends of the full blades 28 in the flow direction of air. The end portions 29*a* of the splitter blades 29 are upstream ends of the splitter blades 29 in the flow direction of air. The end portions 28*b* of the full blades 28 are downstream ends of the full blades 28 in the flow direction of air. The end portions 29*b* of the splitter blades 29 are downstream ends of the splitter blades 29 in the flow direction of air.

At the upstream ends of the full blades 28 (end portions 28*a*), the short blade 29 is not present between the full blades 28, and hence the flow passage is not divided by the short blade 29. Therefore, a large amount of air flows into the gaps between the blades 27.

Further, as described above, the compressor impeller 22 includes the splitter blades 29 and the thinned portion 26*e*. Downweighting can be achieved by the thinned portion 26*e*. The splitter blades 29 function as ribs. Therefore, the strength can be improved without increasing the air resistance in the thinned portion 26*e*.

Figure 4:
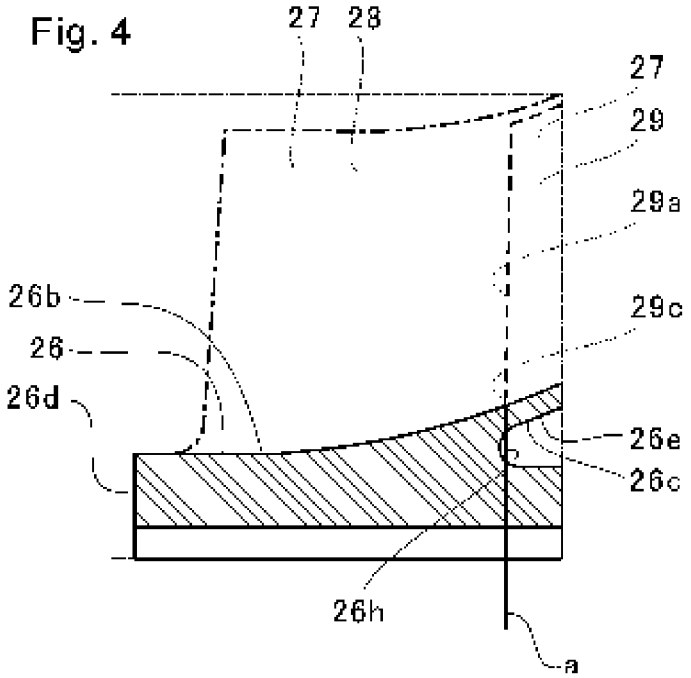
FIG. 4 is an extraction view of the two-dot chain line portion of FIG. 3.

FIG. 4 is an extraction view of the two-dot chain line portion of FIG. 3. In FIG. 4, there is illustrated a draw-out line a which extends in a direction perpendicular to the rotation axis of the compressor impeller 22 from a portion 29*c* of the end portion 29*a* of the short blade 29 on the radially innermost side. As illustrated in FIG. 4, the end portion 29*a* of the short blade 29 is slightly inclined with respect to a direction of a plane perpendicular to the rotation axis of the compressor impeller 22. The portion 29*c* of the short blade 29 on the radially innermost side is located on the most front end surface 26*d* side (left side in FIG. 4) of the short blade 29.

According to comparison between the draw-out line a and the thinned portion 26*e*, a deepest portion 26*h* of the thinned portion 26*e* reaches a position deeper than the end portion 29*a* of the short blade 29 on the front end surface 26*d* side. In the deepest portion 26*h* of the thinned portion 26*e*, a position in the rotation axis direction is located between the end portion 29*a* of the short blade 29 and the end portion 28*a* of the long blade 28. That is, the thinned portion 26*e* extends in the rotation axis direction to a position between the end portion 29*a* of the short blade 29 and the end portion 28*a* of the long blade 28. Herein, an example is given of a case in which the deepest portion 26*h* of the thinned portion 26*e* reaches a position deeper than the end portion 29*a* of the short blade 29 on the front end surface 26*d* side. However, the deepest portion 26*h* of the thinned portion 26*e* may extend to the position which is the same as the positions of the end portions 29*a* of the splitter blades 29 on the front end surface 26*d* side.

As described above, the strength of the compressor impeller 22 is improved by the splitter blades 29 and the rib 26*g*. Therefore, the deepest portion 26*h* of the thinned portion 26*e* can be extended to the position which is deeper than the end portion 29*a* of the short blade 29 on the front end surface 26*d* side. Alternatively, the deepest portion 26*h* of the thinned portion 26*e* can be extended to the position which is the same as the positions of the end portions 29*a* of the splitter blades 29 on the front end surface 26*d* side. In such a manner, further downweighting can be achieved.

The embodiment has been described above with reference to the attached drawings, but, needless to say, the present disclosure is not limited to the above-mentioned embodiment. It is apparent that those skilled in the art may arrive at various alternations and modifications within the scope of claims, and those examples are understood as naturally falling within the technical scope of the present disclosure.

For example, in the above-mentioned embodiment, description is made of the case in which the rib 26*g* is formed. However, the rib 26*g* may be omitted as long as at least the full blades 28 and the splitter blades 29 are formed. In the case in which the rib 26*g* is formed, for example, as compared to the case in which the rib extends in the radial direction, the air resistance in the thinned portion 26*e* can be suppressed when the compressor impeller 22 is rotated. That is, the degradation in efficiency can be suppressed while improving the strength.

Further, in the above-mentioned embodiment, description is made of the case in which the plurality of blades 27 include the full blades 28 and the splitter blades 29. However, the splitter blades 29 may be omitted as long as at least the rib 26*g* is formed. In this case, all of the blades 27 are the full blades 28. For example, in order to secure the amount of inflow air, the number of blades is reduced to a half by the omission of the splitter blades 29. However, the rib 26*g* is formed, and hence, as described above, the strength can be improved by the rib 26*g*, and the reduction in efficiency due to the air resistance of the rib 26*g* can be suppressed.

Further, in the above-mentioned embodiment, description is made of the case in which the thinned portion 26*e* is formed so that the thickness of the portion at which the back surface 26*c* is formed is substantially constant. However, the thickness of the portion at which the back surface 26*c* is formed is not always substantially constant. When the thinned portion 26*e* is formed so that the thickness of the portion at which the back surface 26*c* is formed is substantially constant, the following effect is attained. That is, for example, when the compressor impeller 22 is manufactured by, for example, injection molding, flowability during molding is improved.

Further, in the above-mentioned embodiment, description is made of the case in which the deepest portion 26*h* of the thinned portion 26*e* is located at the position which is the same as the positions of the end portions 29*a* of the splitter blades 29 on the front end surface 26*d* side. Description is also made of the case in which the deepest portion 26*h* of the thinned portion 26*e* reaches the position deeper than the end portions 29*a*. However, the deepest portion 26*h* of the thinned portion 26*e* may be shallower than the end portions 29*a* of the splitter blades 29 on the front end surface 26*d* side.

Further, in the above-mentioned embodiment, description is made of the electric supercharger C as an example. However, the above-mentioned configuration may be applied to a supercharger other than the electric supercharger C. Further, the above-mentioned configuration may be applied not only to the supercharger but also to, for example, an impeller for a centrifugal compressor. When the above-mentioned configuration is applied to the compressor impeller 22 of the electric supercharger C, further downweighting can be achieved by increasing the size of the thinned portion 26*e*. This is because the rotation speed of the compressor impeller 22 during use is relatively low, and hence the requested strength is not excessively high.

Further, in the above-mentioned embodiment, description is made of the compressor impeller 22 as an example. However, the above-mentioned configuration may be applied to a turbine impeller of a turobcharger.

In the above-mentioned embodiment, description is made of the case in which the compressor impeller 22 is made of CFRP. However, the compressor impeller 22 may be made of other materials such as aluminum alloy. When the compressor impeller 22 is made of CFRP, together with the above-mentioned configuration, further downweighting can be achieved, and the strength can be synergistically improved. This is because CFRP is light and has high strength.

INDUSTRIAL APPLICABILITY

The present disclosure can be used for an impeller having a plurality of blades on an outer circumferential surface of a main body portion, and for a supercharger.

What is claimed is:

1. An impeller, comprising:

a main body portion which is increased in diameter from one side to another side in a rotation axis direction;

a plurality of full blades which are formed on an outer circumferential surface of the main body portion so as to be oriented toward the one side in the rotation axis direction;

a plurality of splitter blades, which are formed on the outer circumferential surface, and have end portions being located on the one side in the rotation axis direction and being positioned on the another side in the rotation axis direction with respect to end portions of the full blades; and a thinned portion, which is formed in a back surface of the main body portion so as to be oriented toward the another side in the rotation axis direction, and is recessed toward the one side in the rotation axis direction, wherein the thinned portion has a deepest portion, which is located between the end portions of the splitter blades and the end portions of the full blades in the rotation axis direction, and wherein the thinned portion includes a cylindrical portion protruding from an inner circumferential surface of the thinned portion toward the another side in the rotation axis direction, which is formed on a back surface side of the main body portion, a free end of the cylindrical portion being positioned within the thinned portion in the rotation axis direction, and a rib protruding from the inner circumferential surface of the thinned portion toward the another side in the rotation axis direction, which is arranged apart from the cylindrical portion in a radial direction of the main body portion, and which presents an annular shape, a free end of the rib being positioned within the thinned portion in the rotation axis direction.

2. A supercharger, comprising an impeller according to claim 1.

3. The impeller according to claim 1, wherein another end portions of the full blades and another end portions of the splitter blades extend to substantially same positions in the rotation axis direction and in the radial direction.

* * * * *